United States Patent [19]

Kaman

[11] 4,200,023

[45] Apr. 29, 1980

[54] STRINGED MUSICAL INSTRUMENT NECK AND BODY STRUCTURE

[76] Inventor: Charles H. Kaman, Prattling Pond Rd., Farmington, Conn. 06032

[21] Appl. No.: 905,271

[22] Filed: May 15, 1978

[51] Int. Cl.[2] ..... G10D 3/00; G10D 1/08

[52] U.S. Cl. ..... 84/293

[58] Field of Search ..... 84/291, 293

[56] References Cited

U.S. PATENT DOCUMENTS

| | | | |
|---|---|---|---|
| 1,074,458 | 9/1913 | Pileri | 84/293 |
| 2,100,249 | 11/1937 | Hart | 84/293 |
| 2,497,116 | 2/1950 | Dopyera | 84/293 |
| 2,998,742 | 9/1961 | Pratt | 84/293 X |
| 3,244,054 | 4/1966 | Berglund | 84/293 |
| 3,911,778 | 10/1975 | Martin | 84/293 X |

*Primary Examiner*—Lawrence R. Franklin

*Attorney, Agent, or Firm*—McCormick, Paulding & Huber

[57] ABSTRACT

A guitar or similar stringed musical instrument has a neck reinforced by an elongated metal stiffener embedded in the main part or body of the neck which is made of wood, foamed plastic or other suitable material. The stiffener carries a tension rod and holds the rod in a bowed condition so that increasing the tension in the rod, as by tightening a tension nut, will bend the top of the stiffener and the associated top portion of the remainder of the neck rearwardly to compensate for bending due to string loads, and the stiffener material is strategically placed to enhance the stiffener's resistance to string load bending. The joint between the body and the neck is readily releasable for disassembly of the neck from the body, yet it provides a firm, rigid connection between the neck and body which is acoustically sound and prevents movement of the neck in any direction relative to the body. The joint design is also one enabling a close, neat appearing fit or joint line between the neck and body to be achieved with relative ease.

4 Claims, 8 Drawing Figures

STRINGED MUSICAL INSTRUMENT NECK AND BODY STRUCTURE

BACKGROUND OF THE INVENTION

This invention relates to stringed musical instruments of the kind having a body and a neck, such as guitars, and deals more particularly with an improved construction of a stiffener for reinforcing the neck of such an instrument and of the structure of the joint between the neck and the instrument body.

This application relates to stringed instrument structure generally similar to that shown by copending patent application Ser. No. 844,875, filed Oct. 25, 1977, and it involves an improvement of such structure.

The general object of this invention is to provide a stringed musical instrument having a neck reinforced by a tension rod carrying stiffener with the stiffener being designed so that its material is strategically placed to maximize its stiffness against bending under string loads while nevertheless using only a small amount of stiffener material, thereby enabling the stiffener to be of relatively light weight.

Another object of the invention is to provide a stringed instrument structure of the foregoing character wherein the lower end of the stiffener and the upper end of the body cooperate to form an exceptionally strong and firm joint between the neck and the body providing excellent resistance to movement of the neck in any direction relative to the body by string forces, shock forces or any other forces imposed thereon.

A further object of the invention is to provide a neck and body construction of the foregoing character which enables a close, neat joint between the neck and the body to be made with ease, even in cases where the construction is used in instruments made in substantial quantity under normal mass production conditions.

A still further object of the invention is to provide a stringed instrument structure achieving all of the foregoing objects and which also provides a releasable joint between the neck and the body enabling a neck to be readily assembled to or disassembled from its associated body.

Other objects and advantages of the invention will be apparent from the drawings and from the description forming a part hereof.

SUMMARY OF THE INVENTION

The invention resides in an elongated stiffener used to reinforce the neck of a guitar or similar stringed instrument and in the structure of the stiffener, body and other parts of the instrument used to provide a joint between such reinforced neck and its associated body.

In particular, the invention resides in the stiffener having two laterally spaced side walls, a rear wall extending transversely between the side walls to define a U-shaped recess which receives a tension rod, and a number of transverse ribs which extend between the side walls forwardly of the tension rod and hold the tension rod in a bowed condition.

The invention also more particularly resides in the lower end of the stiffener having a tongue, with two parallel side walls, received by a conforming recess in the upper end of the body. At the upper end of the tongue, two laterally outwardly extending flanges bear against the outside surface of the body, adjacent the body recess, with the lower end surface of the stiffener being spaced from the bottom surface of the body recess to assure bottoming of the stiffener against the body surface. The body recess is formed by a block of material integral with the remainder of the body and the stiffener is connected to the body by one or more threaded fasteners passing vertically through the block and threadably engaged with the stiffener, and the tension rod also passes through the block and aids in holding the neck to the body. The main part or body of the neck has its lower end surface flush with the downwardly facing bearing surfaces of the stiffener flanges and, therefore, this lower end surface is accurately located relative to the body surface to form a neat, close joint line between the body and neck.

DETAILED DESCRIPTION OF THE PREFERRED EMBODIMENT

As used herein, and in the claims which follow, the relative terms "upper", "lower", "forward", "rear", and their derivatives are used with the instrument in question assumed to be oriented with its peghead uppermost, with its neck generally vertical, and with its soundboard facing the viewer.

Figure 1:
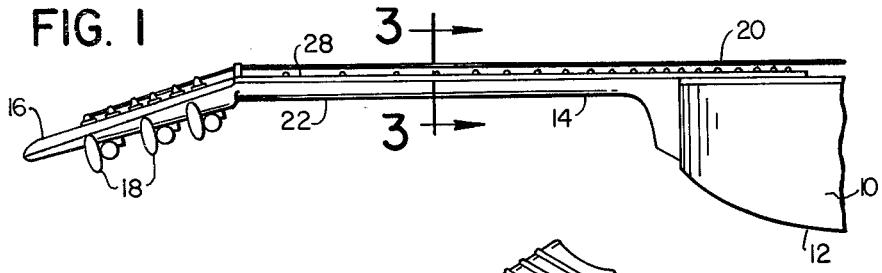
FIG. 1 is a fragmentary side view of a guitar embodying the present invention.

FIG. 1 shows a fragment of a guitar 10 embodying the invention. This guitar is of a generally conventional character insofar as it includes a hollow body 12 and a neck 14 extending upwardly from the upper end of the body. At its upper end the neck 14 has a peghead 16 carrying a number of machines 18, 18 each associated with one of the strings 20, 20. Each string at its upper end is attached to its associated machine 18 and at its lower end is attached to a suitable bridge or tailpiece (not shown).

Figure 2:
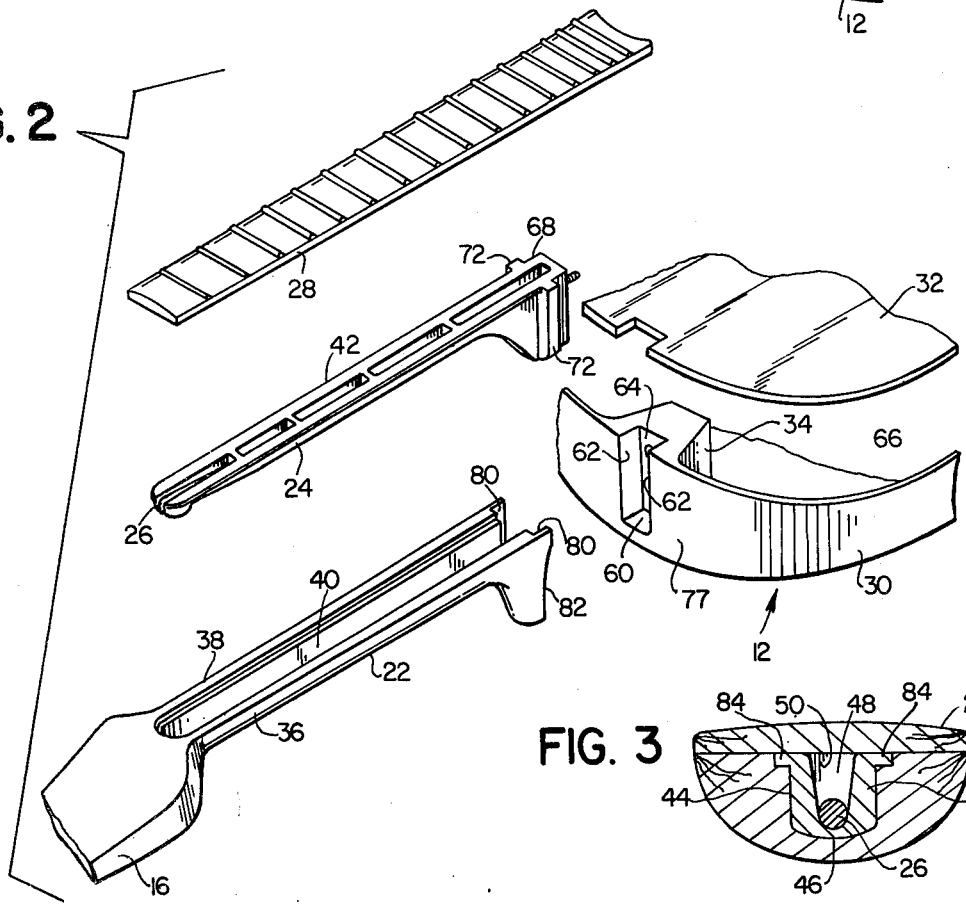
FIG. 2 is an exploded view of the portion of the guitar shown in FIG. 1.

In accordance with the invention, and as shown in FIG. 2, the neck 14 is an assembly of parts including a main neck part or body 22, a stiffener 24, a tension rod 26, and a fretted fingerboard 28. The body 12 includes a bowl 30 and a soundboard 32. The bowl 30, preferably and as shown, is a one-piece unit made of a molded material such as a plastic or a composite material consisting of fiberglass or other fibers embedded in a resin matrix. The bowl 30 is also relatively thin-walled throughout its entire extent except that at its upper end, at the location of its connection to the neck 14, it includes a relatively massive block 34 of the bowl material formed integral with the adjacent thin walls of the bowl. The soundboard or top 32 may be made of wood or other suitable material such as the graphite and wood sandwich shown in U.S. Pat. No. 3,880,040, and it is attached along its periphery to the forwardly facing edge of the bowl 30 by adhesive or other suitable means.

Between the peghead 16 and its lower end, the neck part 22 has a rounded rear surface 36 and a flat forward surface 38. A longitudinally extending groove 40 opens forwardly onto the forward surface 38 and receives a conforming elongated portion 42 of the stiffener 24. The fingerboard is glued or otherwise fixed to the forward surface 38 of the neck part 22 so as to overlie the stiffener and conceal it from view. Along their common length, the stiffener portion 42 is fixed to the main neck part 22. This fixing may be achieved in various different ways depending on the material of the neck part 22 and stiffener 24. In the illustrated case, the neck part 22 is made of wood, and it is fixed to the stiffener through the use of a suitable adhesive between the two. On the other hand, the neck part 22 may, in an alternative construction, be made, for example, of a structural foamed plastic foamed in place around the stiffener 24, and the fixing of the stiffener to the neck may be achieved merely by roughening the surface of the stiffener prior to the foaming of the neck part to produce a mechanical interlocking of the neck part material with the stiffener material. Also, if desired, in the case of a neck part 22 made of structural foamed plastic, the stiffener 24 may be provided with more prominent irregularities such as lugs or protrusions on its outside surface to provide a still more positive interlock between the plastic and the stiffener.

Figure 3:
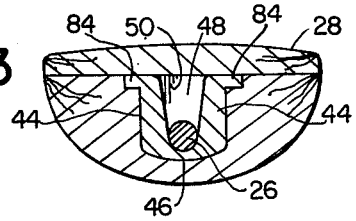
FIG. 3 is a vertical sectional view taken on the line 3—3 of FIG. 1.
Figure 4:
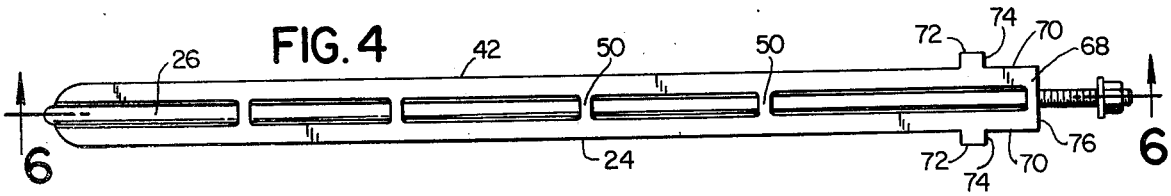
FIG. 4 is a top view of the stiffener and tension rod used in the neck of the guitar of FIG. 1.
Figure 5:
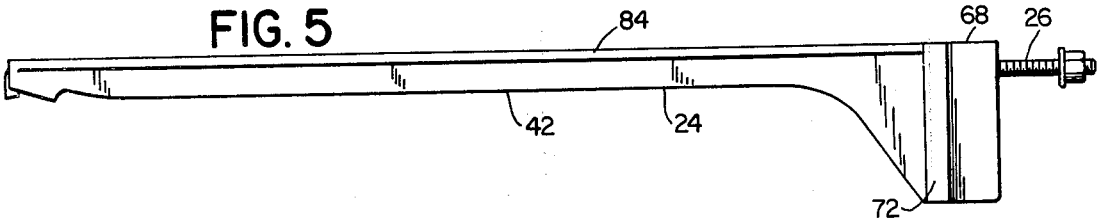
FIG. 5 is a side view of the stiffener and tension rod of FIG. 4.
Figure 6:
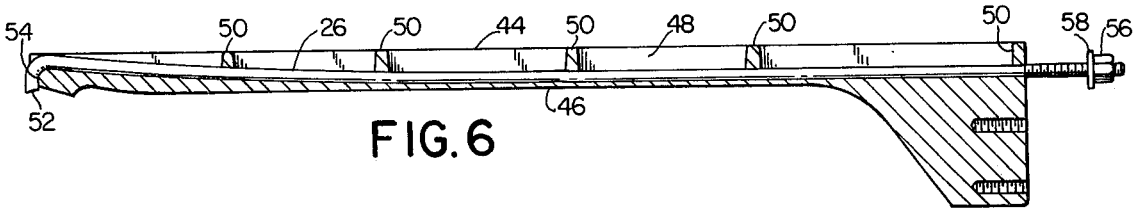
FIG. 6 is a vertical longitudinal view taken on the line 6—6 of FIG. 4 with the tension rod being shown in elevation.

The structure of the stiffener 24 and of its associated tension rod 26 is shown in detail in FIGS. 4, 5 and 6. Referring to these figures, the elongated portion 42 of the stiffener is comprised of two spaced vertical side walls 44, 44 and a rear bottom wall 46, extending between the two side walls, so as to provide the stiffener with a generally U-shaped recess 48, as shown in FIG. 3, extending along its length. The forward surface of the bottom wall is concavely curved, as shown in FIG. 6. The tension rod 26 is received in the stiffener recess 48 and is held in the bowed position shown in FIG. 6 and generally against the curved forward surface of the rear wall 46 by a plurality of ribs 50, 50 which extend transversely between the side walls 44, 44, forwardly of the tension rod. At its upper end, the tension rod is bent to define an end post 52 extending rearwardly generally perpendicular to the remainder of the rod and engageable with an abutment surface 54 on the upper end of the stiffener to limit movement of the rod relative to the stiffener in the direction toward the opposite or lower end of the rod.

Figure 7:
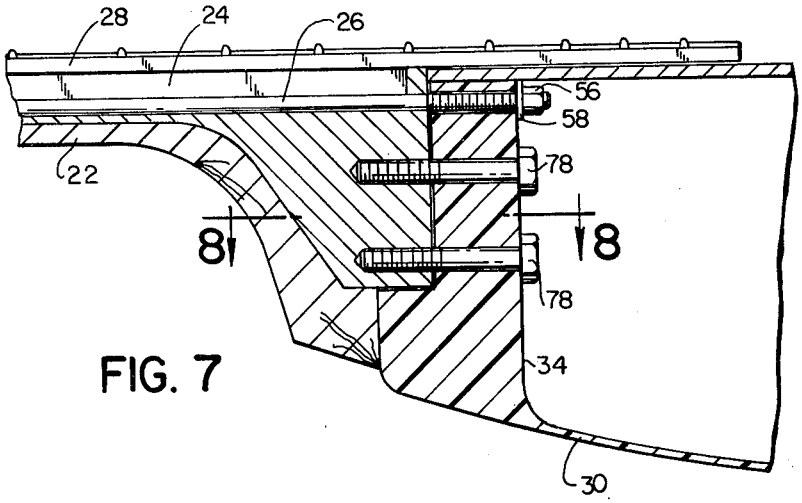
FIG. 7 is a fragmentary vertical longitudinal sectional view, taken on the line 7—7 of FIG. 8, through the connection between the neck and the body of the guitar of FIG. 1.

The lower end of the tension rod 26 extends beyond the lower end of the stiffener and threadably receives an adjustment nut 56 and washer 58. In the assembled instrument, as shown in FIG. 7, the adjustment nut may be tightened or loosened to shorten or lengthen the effective length of the tension rod to cause the upper end of the stiffener and the associated upper end portions of the other parts of the neck to move forwardly or rearwardly. The stiffener and tension rod are made of materials having relatively high moduli of elasticity in comparison to the material of the neck part 22 so that a given adjustment of the adjustment nut 56 will achieve a relatively high degree of bending of the stiffener in comparison to the degree of bending which would be obtained if the neck did not include the stiffener and the tension rod worked directly on the material of the neck part itself. Preferably, and in the illustrated case, the stiffener is die cast and is made of a relatively lightweight metal such as aluminum or magnesium and the tension rod is made of steel.

Figure 8:
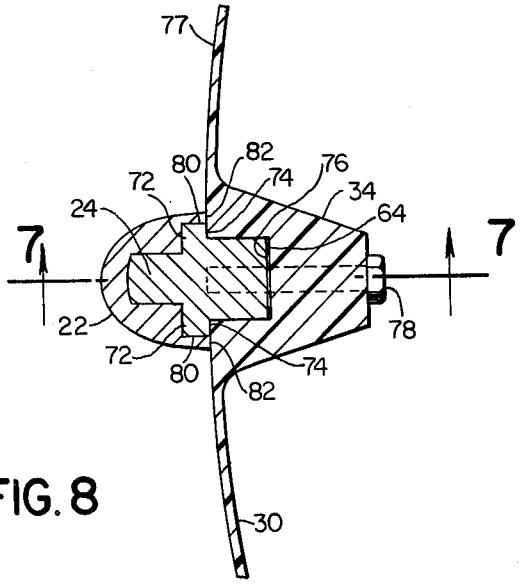
FIG. 8 is a horizontal sectional view taken on the line 8—8 of FIG. 7.

FIGS. 2, 7 and 8 show best the details of the connection between the neck 14 and the body 12. As shown in these figures, the block 34 is shaped to define, at the upper end of the bowl, an upwardly opening recess 60 defined by two vertical side surfaces 62, 62 and a bottom surface 64, all three surfaces 62, 62 and 64 extending forwardly to the plane of the forward edge 66 of the bowl 30 and extending a substantial distance rearwardly therefrom. The lower end of the stiffener 24, in turn, is rearwardly enlarged and has a tongue 68 generally complementary to the body recess 60. In particular, the stiffener tongue 68 has two parallel side surfaces 70, 70 which are designed to relatively snugly engage the side surfaces 62, 62 of the body recess while nevertheless permitting the stiffener tongue to be manually moved into the recess by hand pressure.

At the upper end of the tongue 68 are two laterally extending flanges 72, 72, each adjacent a respective one of the side surfaces 70, 70 and each having a downwardly facing bearing surface 74. At the very lower end of the tongue is an end surface 76. The distance between the end surface 76 and the flange surfaces 74, 74 is such that the flange surfaces 74, 74 bottom out or engage the outside surface 77 of the bowl 30 adjacent the edges of the bowl recess 60, as shown in FIG. 8, before the end surface 76 of the stiffener engages the bottom surface 64 of the recess. That is, in the assembled instrument, the stiffener end surface 76 is spaced from the recess bottom surface 64 to assure sound contact between the stiffener flanges 72, 72 and the body bowl 30. The flanges engage the outside surface of the body along their entire lengths and, therefore, provide resistance to both back and forth and side to side tilting movement of the neck relative to the body.

The neck is further held to the body by two screws 78, 78 which pass through the block 34 and are threadably received by the stiffener 24. These screws have heads which bear against the lower surface of the block 34 to compress the block between the heads of the screws and the stiffener thereby drawing the flanges 72, 72 of the stiffener into firm engagement with the body.

As shown in FIG. 7, the lower end of the tension rod 26 passes through the block 34 and has its washer 58 and adjustment nut 56 working against the block 34. Therefore, when the adjustment nut 56 is tightened it not only serves to tension the tension rod but also aids in holding the stiffener and the remainder of the neck to the body.

The main part 22 of the neck, adjacent its lower end, has a rearwardly extending portion which is recessed, as indicated at 80, 80 in FIGS. 2 and 7, to accommodate the stiffener flanges 72, 72, and at its very lower end has an end surface 82 which is flush with the flange surfaces 74, 74. Therefore, when the flange surfaces, in the act of assembling the neck with the body, are brought into engagement with the outside surface 77 of the body the end surface 82 of the neck part is likewise brought into contact with the outside body surface to provide a neat joint line between the neck and the body. In other words, in the production of an instrument, a neat joint between the neck and the body can be assured by the simple expedient of making the end surface of the main part 22 of the neck flush with the stiffener flange surfaces 74, 74, therefore avoiding problems, particularly when producing instruments in quantity, in achieving neat joint lines due to slight deviations in the dimensions of supposedly identical parts from one part to another.

In viewing FIGS. 2 and 7 it will also be understood that the joint between the neck and the body is one that can easily be disassembled by removing the fasteners 78, 78 and the adjustment nut 56 from the tension rod 26. Access to the fasteners 78, 78 and to the adjustment nut 56 can be had by reaching into the interior of the body through the customary sound hole, but if the soundhole is too small, or if preferred for other reasons, a separate access door may be built into the body.

A prime purpose of the stiffener, as mentioned, is to resist bending of the neck under string loads, and in this regard its stiffness is enhanced by placing a large amount of the stiffener material, as represented by the rear wall 46, at the rear of the stiffener. The forward portion of the stiffener, however, does also carry some compressive loads, and because of this the stiffener also preferably includes, as shown, two outwardly extending flanges 84, 84 each extending along the length of the stiffener and each located at the forward edge of an associated one of the side walls 44, 44 to still further enhance the part's stiffness.

I claim:

1. A stringed musical instrument having a body with upper and lower ends, and a neck extending upwardly from said upper end of said body, said neck being an assembly of parts including a main part having a forward surface and a curved rear surface and also having a forwardly opening groove in said forward surface extending longitudinally of said main part, an elongated stiffener received in said groove of said main part and fixed to said main part along substantially their entire common length, and a fingerboard overlying said forward surface of said main part and said stiffener, characterized by said body having at its upper end an outside surface and a block defining an upwardly opening recess in said outside surface, said recess having two generally vertical side surfaces and a bottom surface extending between said side surfaces, said stiffener having a rearwardly enlarged lower end portion including a tongue received in said body recess and which tongue has two generally parallel side surfaces engaged with said side surfaces of said body recess, said lower end portion of said stiffener also including two flanges at the upper end of said tongue each of which flanges extend laterally outwardly from an associated one of said side surfaces of said tongue and has a downwardly facing bearing surface which engages said outside surface of said body adjacent the corresponding edge of said body recess, said tongue having a lower end surface extending between its side walls and spaced upwardly from said bottom surface of said body recess, fastener means cooperating with said body and with said stiffener for holding said downwardly facing bearing surfaces of said stiffener flanges in tight engagement with said outside surface of said body, said main part of said neck having a rearwardly extending portion at its lower end which is recessed to receive said stiffener flanges and which has an end surface flush with said downwardly facing bearing surfaces of said flanges and at least approximately engaged with said outside surface of said body to provide a neat joint line between said neck and said body and to conceal said stiffener from view, a tension rod extending longitudinally through said stiffener, means at the upper end of said stiffener limiting movement of the upper end of said tension rod toward its lower end, said tension rod at its lower end extending downwardly beyond the lower end of said tongue and through and beyond said block, and a nut threaded onto said lower end of said tension rod and workable against the lower surface of said block to tension said tension rod and to thereby axially compress and bend said stiffener and to assist said fastener in holding said stiffener flanges in tight engagement with said outside surface of said body.

2. A stringed musical instrument having a body with upper and lower ends, and a neck extending upwardly from said upper end of said body, said neck being an assembly of parts including a main part having a forward surface and a forwardly opening groove in said forward surface extending longitudinally of said main part, an elongated stiffener received in said groove of said main part and fixed to said main part along substantially their entire common length, and a finger board overlying said forward surface of said main part and said stiffener, characterized by said body having at its upper end a block with an upwardly opening recess, said stiffener having a lower end portion including a tongue received in said body recess, said lower end portion of said stiffener also including two flanges at the upper end of said tongue each of which flanges extend laterally outwardly from an associated one of the side surfaces of said tongue and has a downwardly facing bearing surface which engages the outside surface of said body adjacent the corresponding edge of said body recess, said tongue having a lower end surface spaced upwardly from the bottom surface of said body recess, said main part of said neck being recessed at its lower end to receive said stiffener flanges and having an end surface flush with said downwardly facing bearing surfaces of said flanges and at least approximately engaged with said outside surface of said body, fastener means cooperating with said body and with said stiffener tongue for releasably fixing said stiffener to said body and for holding said downwardly facing bearing surfaces of said stiffener flanges in tight engagement with said outside surface of said body, a tension rod extending longitudinally through said stiffener, means at the upper end of said stiffener limiting movement of the upper end of said tension rod toward its lower end, said tension rod at its lower end extending downwardly beyond the lower end of said tongue and through and beyond said block, and a nut threaded onto said lower end of said tension rod and workable against the lower surface of said block to tension said tension rod and to thereby axially compress and bend said stiffener and to assist said fastener means in fixing said stiffener to said body.

3. A stringed musical instrument as set forth in claim 1 and further characterized by said stiffener having two side walls spaced laterally from one another and a rear wall extending between said side walls to define a generally U-shaped recess extending along the length of said stiffener, said tension rod being located in said stiffener recess, said stiffener including a plurality of ribs extending transversely between said side walls of said stiffener and spaced from one another along the length of said stiffener, said ribs being located forwardly of said tension rod and holding said tension rod in a bowed condition.

4. A stringed musical instrument as defined in claim 3 further characterized by said stiffener having two laterally outwardly extending flanges each extending along substantially the entire length of said stiffener and located adjacent the forward edge of an associated one of said stiffener side walls.

* * * * *

UNITED STATES PATENT AND TRADEMARK OFFICE

CERTIFICATE OF CORRECTION

PATENT NO. : 4,200,023

DATED : April 29, 1980

INVENTOR(S) : Charles H. Kaman

It is certified that error appears in the above–identified patent and that said Letters Patent are hereby corrected as shown below:

Column 6, line 51, "1" should be --2--.

Signed and Sealed this

*Twenty-second* Day of *July 1980*

[SEAL]

*Attest:*

SIDNEY A. DIAMOND

*Attesting Officer*

*Commissioner of Patents and Trademarks*